US010610009B1

(12) United States Patent
Ciputra et al.

(10) Patent No.: US 10,610,009 B1
(45) Date of Patent: Apr. 7, 2020

(54) REMOVABLE TABLE LEG

(71) Applicants: Berlin Dirgantara Ciputra, Harrisdale (AU); Devina Aurelia Hardjadinata, Harrisdale (AU)

(72) Inventors: Berlin Dirgantara Ciputra, Harrisdale (AU); Devina Aurelia Hardjadinata, Harrisdale (AU)

( * ) Notice: Subject to any disclaimer, the term of this patent is extended or adjusted under 35 U.S.C. 154(b) by 0 days.

(21) Appl. No.: 16/450,071

(22) Filed: Jun. 24, 2019

(51) Int. Cl.
*A47B 13/02* (2006.01)
*A47B 91/02* (2006.01)
*A47B 13/00* (2006.01)

(52) U.S. Cl.
CPC ..... *A47B 13/021* (2013.01); *A47B 13/003* (2013.01); *A47B 91/022* (2013.01); *A47B 2013/022* (2013.01)

(58) Field of Classification Search
CPC ..... A47B 3/06; A47B 57/32; A47B 13/003; A47B 13/021; A47B 2013/022; A47B 91/022
USPC ..... 108/156, 157.1, 157.18, 159.11, 158.13; 248/188, 165
See application file for complete search history.

(56) References Cited

U.S. PATENT DOCUMENTS 518,733 A * 4/1894 Cook ..... A47B 9/08 108/148
1,939,904 A * 12/1933 Koopman ..... A47B 3/12 108/157.18
2,010,342 A * 8/1935 Woods ..... A47B 3/12 108/157.18
2,591,797 A * 4/1952 Exline ..... A47B 3/12 108/62
2,628,141 A * 2/1953 Scheuer ..... A47F 5/0043 108/157.13
2,635,024 A * 4/1953 Sanford ..... A47B 3/12 108/157.18
3,533,586 A 10/1970 Chichester
D233,396 S 10/1974 Arnal
D284,534 S 7/1986 Montenecourt
4,915,534 A * 4/1990 Richards ..... F16B 9/026 108/156
D318,389 S 7/1991 Hawkinson
(Continued)

FOREIGN PATENT DOCUMENTS

EP 3 009738 10/2015

OTHER PUBLICATIONS

Author: Unknown; Title: Tabl; Title of the Item: https://www.kickstarter.com/projects/nickflutter/tabl-the-worlds-most-adaptable-table-leg; Date and Publication: Unknown.

(Continued)

*Primary Examiner* — Jose V Chen
(74) *Attorney, Agent, or Firm* — Eric Karich; Karich & Associates

(57) ABSTRACT

A table leg has an elongate leg having, a locking rod, and an annular knob having an internally threaded hole threadedly receiving the locking rod therethrough. Top and bottom fixed plates are provided for sandwiching the annular knob therebetween. An L-shaped bracket having a vertical portion that extends from a bottom edge to a corner, and a horizontal portion that extends from the corner to a terminal edge, is attached to the top and bottom fixed plates for clamping the table between the horizontal portion and the locking rod.

10 Claims, 6 Drawing Sheets

(56) References Cited

U.S. PATENT DOCUMENTS

| | | | | |
|---|---|---|---|---|
| 8,215,246 | B2 * | 7/2012 | Quam | E04H 3/28 108/156 |
| 9,814,308 | B2 | 11/2017 | Hoff | |
| 2005/0126452 | A1 | 6/2005 | Ziakin | |
| 2010/0012002 | A1 * | 1/2010 | Iso | A61G 13/101 108/158.13 |

OTHER PUBLICATIONS

Author: Unknown; Title: The Floyd Leg; Title of the Item: https://floydhome.com/products?; Date and Publication: Unknown.
Author: Unknown; Title:Woodsman Table Uses Axes for Legs; Title of the Item: https://dornob.com/one-sharp-design-woodsman-table-uses-axes-for-legs/; Date & Publication:Unknown.
Author: Unknown; Title: Clamped tabe by Ryan Sorrell; Title of the Item: https://www.dezeen.com/2009/07/21/clamped-table-by-ryan-sorrell/; Date and Publication: Unknown.

* cited by examiner

REMOVABLE TABLE LEG

BACKGROUND OF THE INVENTION

Field of the Invention

This invention relates generally leg assemblies for tables, benches, and other furniture products which include a generally planar surface, and more particularly to a removable table leg for removable attachment to a table.

Description of Related Art

There are a large number of generally similar removable table legs shown in the prior art. Hawkinson, U.S. D318,389, for example, teaches a removable table leg that includes a single integral construction of two perpendicular walls that extend to a top end that includes a protruding shelf and a roof that form a clamping portion. A bolt and nut extend through a threaded hole in the shelf for grip adjustment on a planar surface.

Arnal, U.S. D233,396, teaches a similar construction formed of a single steel ribbon that is bent into a U-shape at a top end. A knob tightens a lower clamping element against an upper clamping element of this U-shaped top end.

Hoff, U.S. Pat. No. 9,814,308, teaches a table leg assembly of integral construction that is configured to couple to an outer edge of a generally planar member and support it. The leg assembly also includes an adjustable strap to form a bracing structure. Each leg has a cross-section with an upper and lower plate configured to engage the planar member. The lower plate has a threaded hole or nut, so that a thumbscrew may rotate via a knob to secure the leg onto the planar member (table).

The prior art teaches the general concept of a removable table leg. However, the prior art does not teach the particular construction of the present invention, which offers significant improvement over the prior art in terms of reduced costs, ease of manufacture and assembly, and aesthetics. The present invention fulfills these needs and provides further advantages as described in the following summary.

SUMMARY OF THE INVENTION

The present invention teaches certain benefits in construction and use which give rise to the objectives described below.

The present invention provides a table leg adapted to be removably mounted on a table. The table leg includes an elongate leg having a top end and a bottom end; a locking rod having a top end, a bottom end, and an externally threaded outer surface; an annular knob having an internally threaded hole threadedly receiving the locking rod therethrough; a bottom fixed plate having a hole and a mounting surface spaced a distance from the hole, the bottom fixed plate being mounted on the top end of the elongate leg; a top fixed plate having a hole and a mounting surface spaced from the hole; and an L-shaped bracket having a vertical portion that extends from a bottom edge to a corner, and a horizontal portion that extends from the corner to a terminal edge. The top and bottom fixed plates are mounted on the vertical portion of the L-shaped bracket, such that the locking rod extends through the holes of the bottom and top fixed plates, and the annular knob is sandwiched between the bottom and top fixed plates.

A primary objective of the present invention is to provide a removable table leg having advantages not taught by the prior art.

Another objective is to provide a removable table leg which offers significant improvements over the prior art in terms of simplified manufacture and assembly.

A further objective is to provide a table leg clamp which is easily installed without the use of tools or any special skills.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a removable table leg that is adapted to be removably mounted on a table using a clamp mechanism. The removable table leg may be used as a replacement leg for a piece of furniture, or it may be provided in multiples of any desirable number for removable coupling to the table for the assembly of a complete table or similar structure. For purposes of this application, the term "table" is defined to include any form of similar structure having legs, including tables, chairs, benches, etc.

Figure 1:
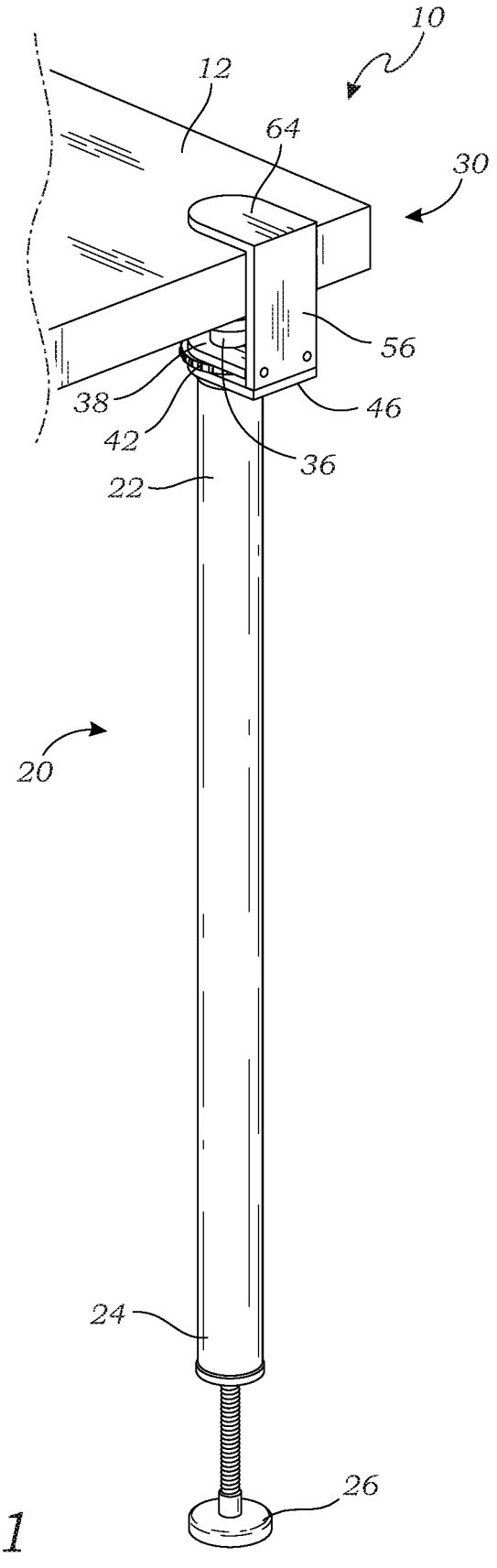
FIG. 1 is a perspective view of a table leg according to one embodiment of the present invention, shown attached to a table.

FIG. 1 is a perspective view of the table leg 10 according to one embodiment of the present invention, shown attached to a table 12. The table leg 10 includes an elongate leg 20 having a top end 22 and a bottom end 24, and a clamp mechanism 30. As shown in FIG. 1, the bottom end 24 of the table leg 10 may include a supporting foot 26.

Figure 2:
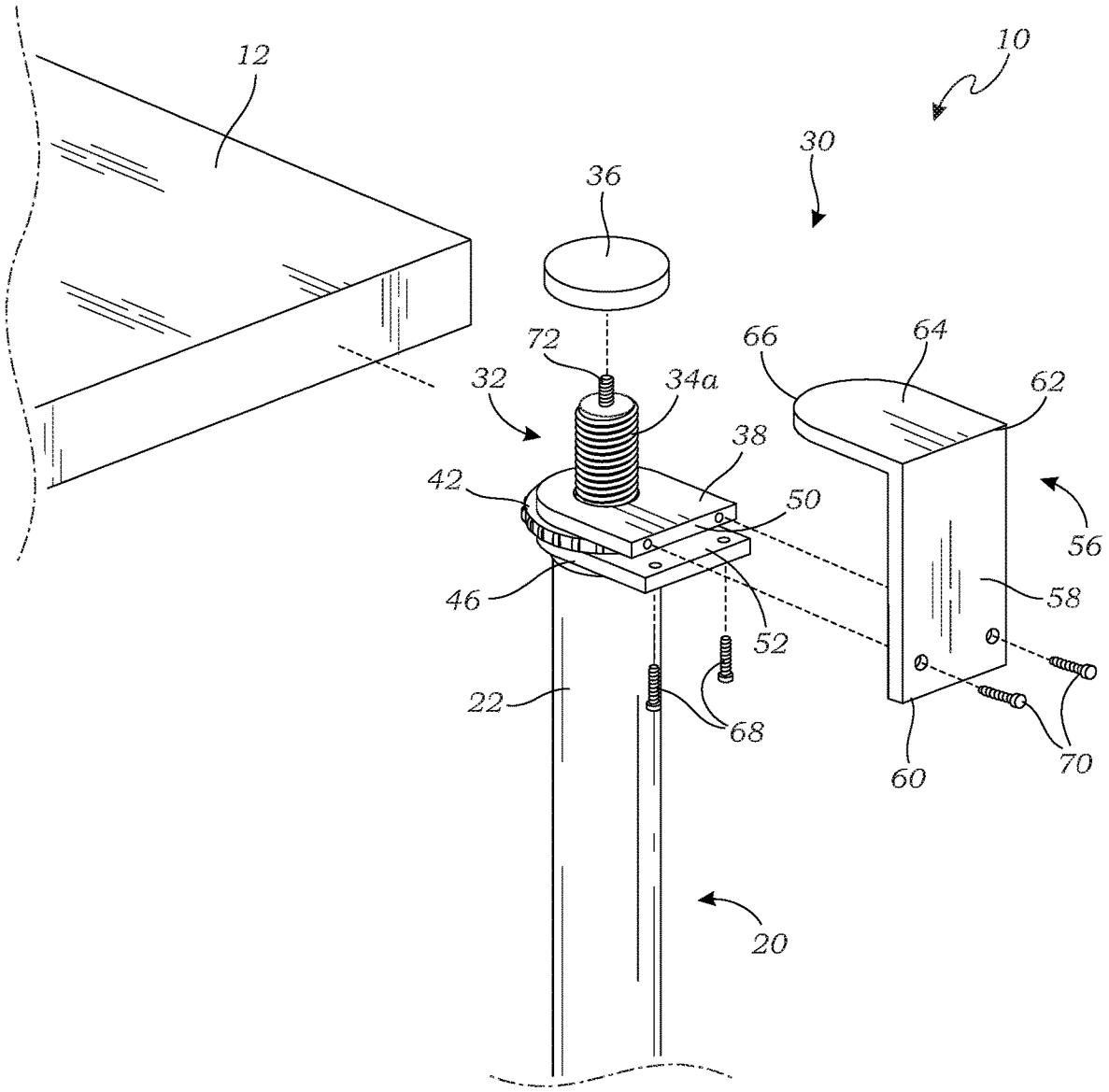
FIG. 2 is a partially exploded perspective view thereof.
Figure 3:
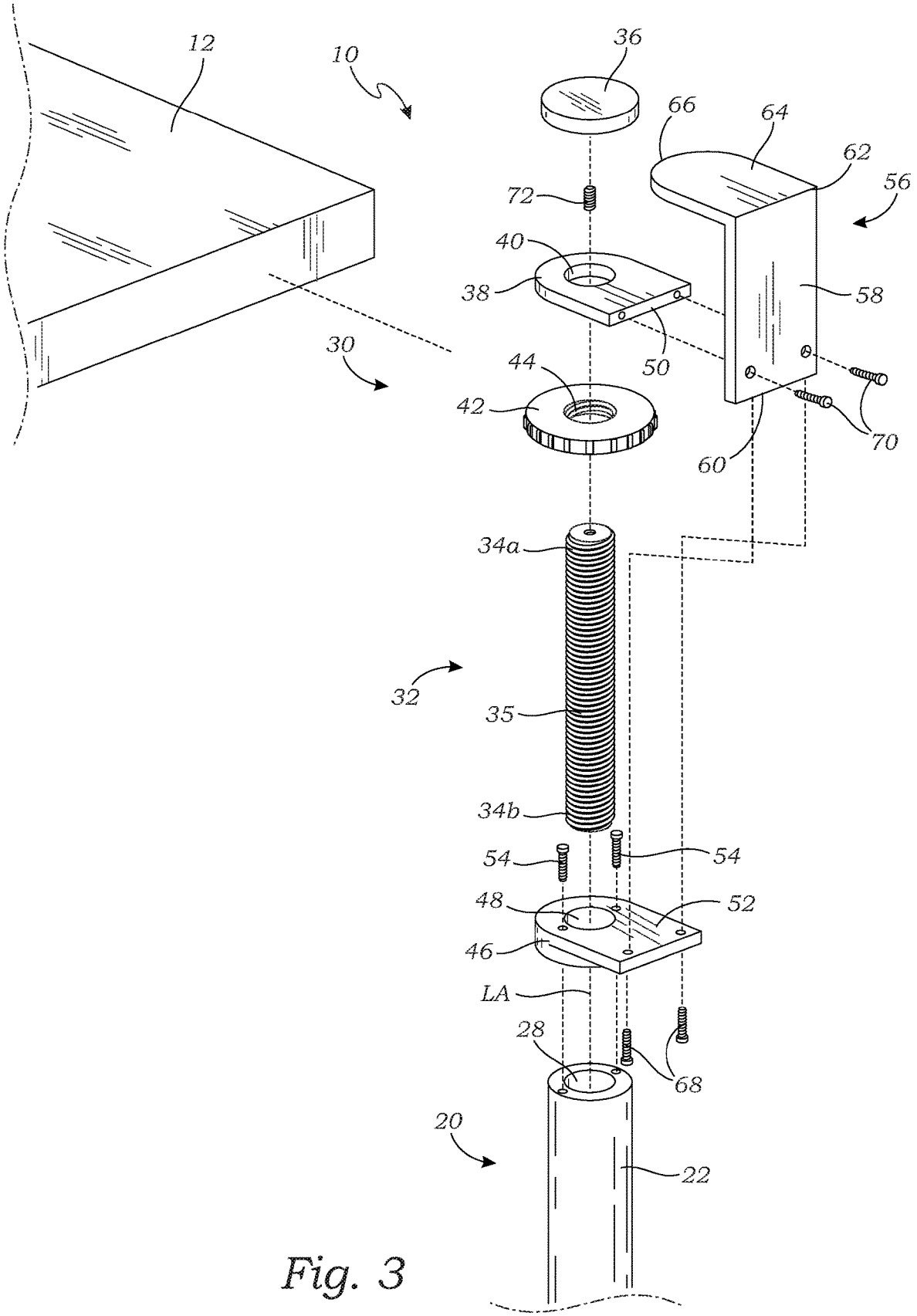
FIG. 3 is a fully exploded perspective view thereof.

FIG. 2 is a partially exploded perspective view of the table leg 10, illustrating the construction of one embodiment of the clamp mechanism 30. FIG. 3 is a fully exploded perspective view of the removable table leg 10. As shown in FIGS. 2-3, the clamp mechanism 30 comprises a locking rod 32 having a top end 34*a*, a bottom end 34*b*, and an externally threaded outer surface 35. The top end 34*a* is adapted to clamp against the lower surface of the table 12. The bottom end 34*b*, shown in FIG. 3, extends downwardly into a bore 28 of the elongate leg 20. The bore 28 is deep enough to allow a full range of motion of the locking rod 32.

In this embodiment, the locking rod 32 includes a clamp plate 36 that is mounted on the top end 34*a* of the locking rod 32 via a pin 72, which provides a suitable surface for contacting the table 12; however, in alternative embodiments, the top end 34*a* itself may contact the table 12, or another surface may be provided, and mounted in any manner known in the art (e.g., an integral structure, another structure attached using other forms of fasteners, etc.).

The locking rod 32 extends through three structures which enable the adjustable movement of the locking rod 32 relative to the elongate leg 20: a top fixed plate 38, an annular knob 42, and a bottom fixed plate 46. The locking rod 32 extends through a hole 40 in the top fixed plate 38, and an internally threaded hole 44 of the annular knob 42, for threadedly receiving the locking rod 32 therethrough. Finally, it extends through a hole 48 of the bottom fixed plate 46. The bottom fixed plate 46 is fixedly mounted on the elongate leg 20, in this case with fasteners 54. Once assembled, the top fixed plate 38 and the bottom fixed plate 46 hold the annular knob 42 therebetween so that rotation of the annular knob 42 moves the locking rod 32 up and down with respect to the elongate leg 20.

The top fixed plate 38 and the bottom fixed plate 46 are both also fixedly attached, as described in greater detail below, to an L-shaped bracket 56. The L-shaped bracket 56 has a vertical portion 58 that extends from a bottom edge 60 to a corner 62, and a horizontal portion 64 that extends from the corner 62 to a terminal edge 66. The top fixed plate 38 and the bottom fixed plate 46 further each have a mounting surface 50 and 52, respectively, spaced a distance from each hole 40 and 48, respectively. The bottom fixed plate 46 is attached to the top end 22 of the elongate leg 20 via the first fastener 54, best shown in FIG. 3, and described in greater detail below. The bottom edge 60 of the vertical portion 58 may be attached via a second fastener 68 to the mounting surface 52 of the bottom fixed plate 46. The vertical portion 58 may be attached via a third fastener 70 to the mounting surface 50 of the top fixed plate 38, adjacent the bottom edge 60 of the vertical portion 58. The horizontal portion 64 of the L-shaped bracket 56 serves as a top jaw of the clamp mechanism 30, when attached to the table 12, as best shown in FIG. 1.

In the embodiment of FIGS. 1-3, the bore 28 of the top end 22 of the elongate leg 20 extends along a longitudinal axis LA of the table leg 10 into the elongate leg 20. The bottom fixed plate 46 is attached to the top end 22 of the elongate leg 20 via the first fastener 54, so that the locking rod 32 extends through the holes 40, 44, and 48 of the top fixed plate 38, the annular knob 42, and the bottom fixed plate 46, respectively, and into the bore 28 of the elongate leg 20. All of the holes 40, 44, and 48 are therefore coaxially aligned along this axis LA.

In the present embodiment, the first, second, and third fasteners 54, 68, and 70 (collectively, "fasteners") each include a pair of screws for engagement with the mounting surfaces 50 and 52 of the top and bottom fixed plates 38 and 46. Washers may be utilized in the case of screws. However, in other embodiments, the fasteners may include other types of fasteners, including mechanical fasteners such as screws, bolts, staples, or other forms such as adhesives, welds, etc.

The clamp plate 36 is adapted for clamping against the table, and may be disk-shaped, or any other suitable shape for removable clamping. As shown in FIG. 3, the clamp plate 36 is attached to the top end 34*a* of the locking rod 32 with the pin 72, though other attachment means may be utilized, such as a threaded rod, welding, adhesives, etc.

Figure 5:
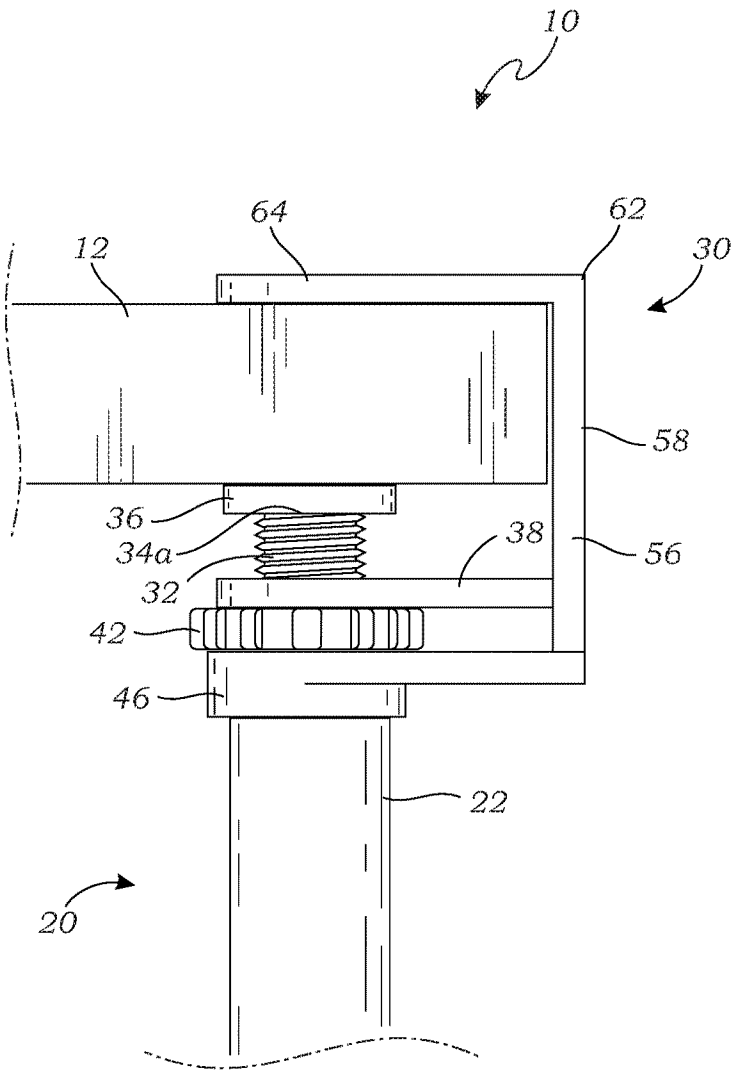
FIG. 5 is a side elevational view of the table leg, illustrating the clamp mechanism in a closed configuration.
Figure 4:
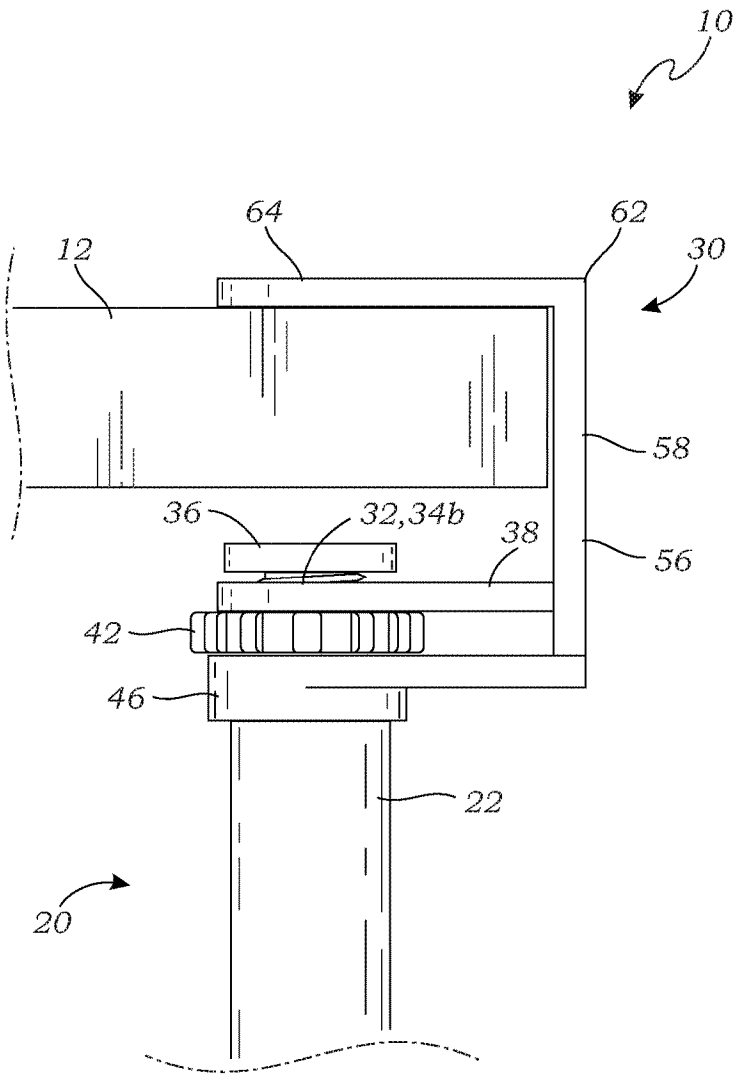
FIG. 4 is a side elevational view of the table leg, illustrating the clamp mechanism in an open configuration.

FIG. 4 is a side elevational view of the table leg 10, illustrating the clamp mechanism 30 in an open configuration. FIG. 5 is a side elevational view of the table leg 10, illustrating the clamp mechanism 30 in a closed configuration. As shown in FIGS. 4-5, rotation of the annular knob 42 causes the locking rod 32 to move upwardly or downwardly with respect to the horizontal portion 64 of the L-shaped bracket 56, adapted to clamp the table between the clamp plate 36 and the horizontal portion 64 of the L-shaped bracket 56.

To secure the clamp mechanism 30 of the removable table leg 10 to the table 12, a user rotates the annular knob 42 until the table 12 is tightly gripped between the clamp plate 36 and the horizontal portion 64 of the L-shaped bracket 56. To remove the clamp mechanism 30 from frictional engagement with the table 12, the user rotates the annular knob 42 in the opposite direction to lower the locking rod 32, and therefore the clamp plate 36, so that the table leg 10 can be fully detached from the table 12.

While one embodiment of the clamping mechanism 30 is shown, the removable table leg 10 may secure to the table 12 without the clamp plate 36, using just the locking rod 32, or any other component suitable for clamping against a the underside of the table 12.

Figure 6:
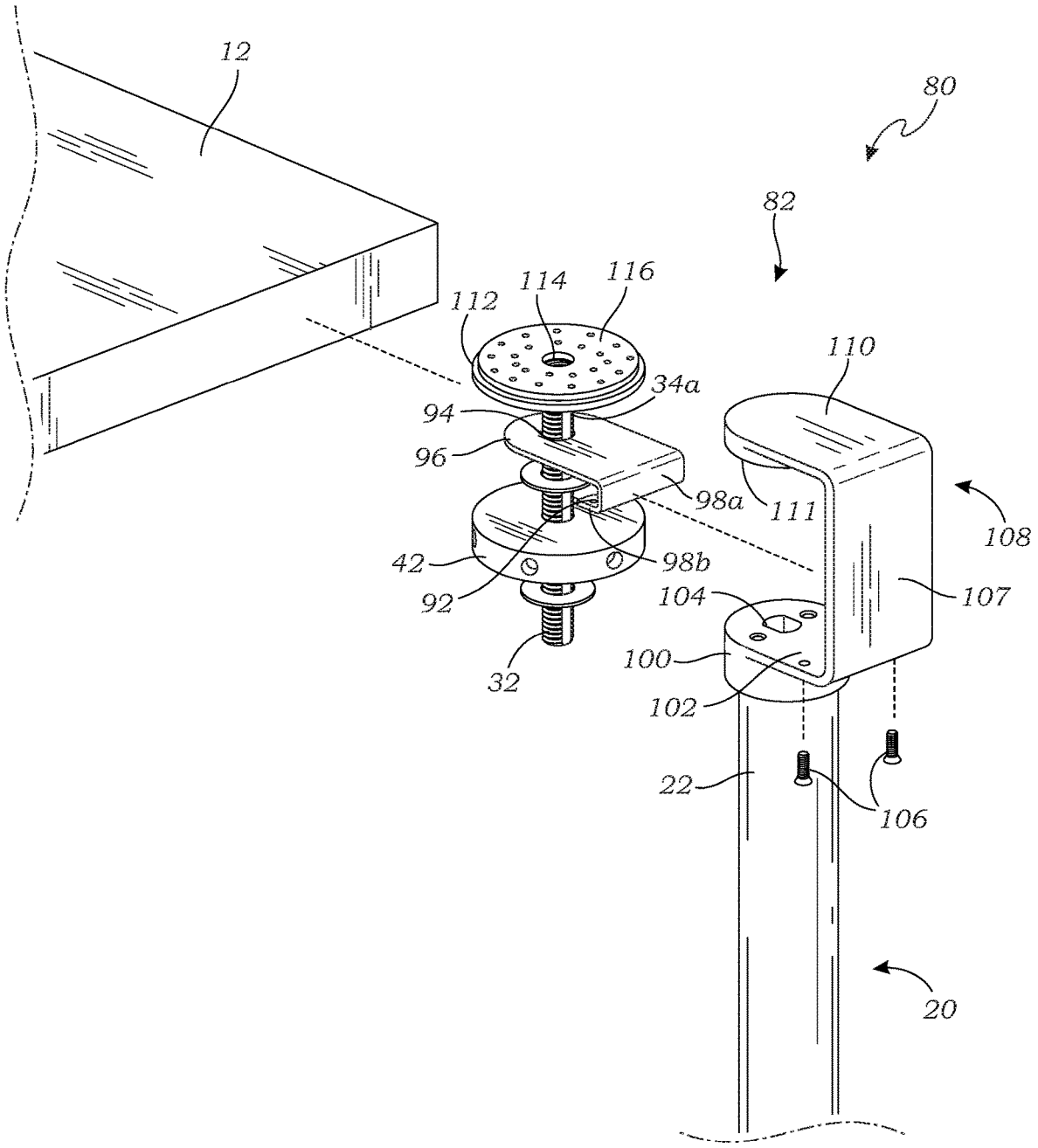
FIG. 6 is an exploded perspective view of a second embodiment of the table leg.
Figure 7:
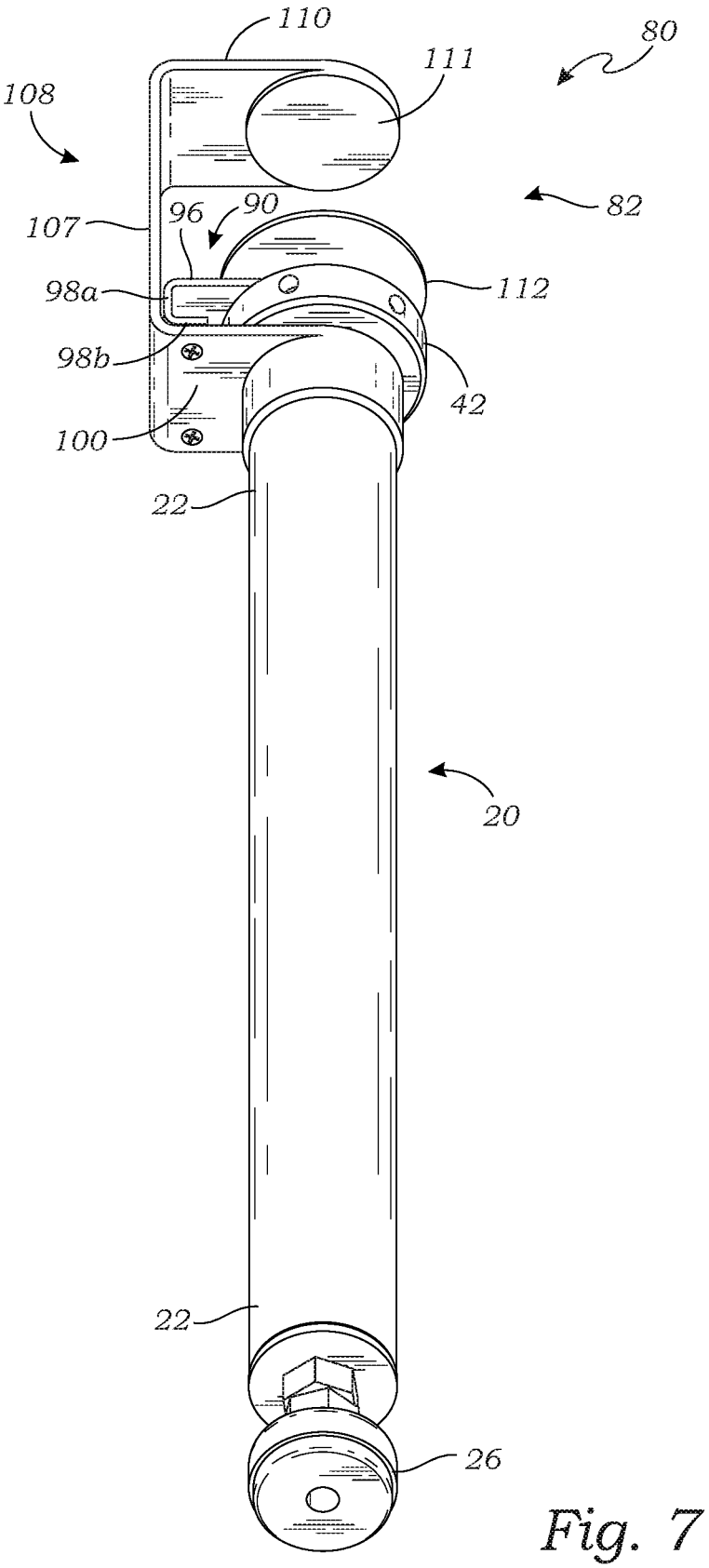
FIG. 7 is a second perspective view thereof.

FIG. 6 is an exploded top perspective view of a second embodiment of the table leg 80. FIG. 7 is a bottom perspective view of the table leg 80 once assembled. As shown in FIGS. 6-7, in this embodiment, the top fixed plate 90 is mounted on the L-shaped bracket 108 via the bottom fixed plate 100, as described in more detail below. Furthermore, in this embodiment, the bottom fixed plate 100 is integrally formed with the L-shaped bracket 108, so that the entirety of the bracket is U-shaped.

For purposes of this application, the requirement that the top and bottom fixed plates are mounted on the vertical portion of the L-shaped bracket, is intended to encompass a direct mounting of two separate components, as shown in the first embodiment, and also an indirect mounting via an intermediary structure, and/or an integral construction.

In the embodiment of FIGS. 6-7, the clamping mechanism 82 may comprise the top fixed plate 90 and the bottom fixed plate 100, each having a mounting surface 92 and 102, respectively, each spaced a distance from holes 94 and 104, respectively. In this embodiment, the top fixed plate 90 is in a general hook-shape, having a main plate 96, and vertical and horizontal portions 98*a* and 98*b* being adapted to engage the edge of the annular knob 42. The mounting surface 92 of the top fixed plate 90 is located on the horizontal portion 98*b*. The mounting surface 102 of the bottom fixed plate 100 is positioned such that when the holes 94 and 104 are aligned in a constructed configuration, mounting surfaces 92 and 102 are also aligned. Mounting surfaces 92 and 102 may then jointly receive a fastening element 106, such as those described above.

In this embodiment, a vertical portion 107 of an L-shaped bracket 108 is integrally formed or welded with the bottom fixed plate 100, such that an additional fastening element may not be needed to secure the clamping mechanism 82 together. A horizontal portion 110 of the L-shaped bracket 108 may further include a raised portion 111 where it grips the table 12 in a clamped configuration, thereby preventing the horizontal portion 110 from directly contacting the table 12. In this embodiment, the top end 34*a* of the locking rod 32 may serve as the bottom jaw to the horizontal portion 110 of the L-shaped bracket 108, or a clamp plate 112 may be provided. As shown in FIG. 6, the clamp plate 112 may have an internally threaded hole 114 for receiving the locking rod 32 therethrough, though may be attached to the locking rod 32 via another mechanism, such as those described in the previous embodiment 10. The clamp plate 112 may additionally have a pad 116 to serve as protection against scratches, dents, etc. on the table 12. The pad 116 may be constructed of rubber, foam, or any other material deemed suitable by those skilled in the art.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A table leg adapted to be removably mounted on a table, the table leg comprising:

an elongate leg having a top end and a bottom end;

a locking rod having a top end, a bottom end, and an externally threaded outer surface;

an annular knob having an internally threaded hole threadedly receiving the locking rod therethrough;

a bottom fixed plate mounted on the top end of the elongate leg;

a top fixed plate;

an L-shaped bracket having a vertical portion that extends from a bottom edge to a corner, and a horizontal portion that extends from the corner to a terminal edge;

the top and bottom fixed plates being mounted on the vertical portion of the L-shaped bracket, such that the locking rod extends through holes of the bottom and top fixed plates, and the annular knob is sandwiched between the bottom and top fixed plates; and wherein rotation of the annular knob causes the locking rod to move upwardly or downwardly with respect to the horizontal portion of the L-shaped bracket, adapted to clamp the table between the locking rod and the horizontal portion of the L-shaped bracket.

2. The table leg of claim 1, further comprising a bore that extends into the elongate leg along a longitudinal axis of the table leg.

3. The table leg of claim 1, further comprising a first fastener for fastening the bottom fixed plate to the top end of the elongate leg.

4. The table leg of claim 1, further comprising a clamp plate that is mounted on the top end of the locking rod, the clamp plate being adapted for clamping against the table.

5. The table leg of claim 4, wherein the clamp plate is disk-shaped, and is attached to the top end of the locking rod with a pin.

6. A table leg adapted to be removably mounted on a table, the table leg comprising:

an elongate leg having a top end and a bottom end, the top end having a bore that extends into the elongate leg;

a locking rod having a top end, a bottom end, and an externally threaded outer surface;

an annular knob having an internally threaded hole threadedly receiving the locking rod therethrough;

a bottom fixed plate having a hole and a mounting surface spaced a distance from the hole;

a first fastener for fastening the bottom fixed plate to the top end of the elongate leg;

a top fixed plate having a hole and a mounting surface spaced from the hole;

an L-shaped bracket having a vertical portion that extends from a bottom edge to a corner, and a horizontal portion that extends from the corner to a terminal edge;

a second fastener for fastening the vertical portion of the L-shaped bracket, adjacent the bottom edge of the vertical portion, to the mounting surface of the bottom fixed plate;

a third fastener for fastening the vertical portion of the L-shaped bracket to the mounting surface of the top fixed plate, such that the locking rod extends through the holes of the bottom and top fixed plates and into the bore of the elongate leg, and the annular knob is sandwiched between the bottom and top fixed plates; and wherein rotation of the annular knob causes the locking rod to move upwardly or downwardly with respect to the horizontal portion of the L-shaped bracket, adapted to clamp the table between the locking rod and the horizontal portion of the L-shaped bracket.

7. The table leg of claim 6, wherein the bore extends into the elongate leg along a longitudinal axis of the table leg.

8. The table leg of claim 6, wherein the first, second, and third fasteners each include a pair of screws.

9. The table leg of claim 6, further comprising a clamp plate that is mounted on the top end of the locking rod, the clamp plate being adapted for clamping against the table.

10. The table leg of claim 9, wherein the clamp plate is disk-shaped, and is attached to the top end of the locking rod with a pin.

* * * * *